US010094066B2

(12) United States Patent
Kent

(10) Patent No.: US 10,094,066 B2
(45) Date of Patent: Oct. 9, 2018

(54) METHOD AND APPARATUS FOR PRE-TREATMENT OF NON CONTINUOUS TEXTILES

(71) Applicant: ColorZen LLC, New York, NY (US)

(72) Inventor: Johnny J Kent, Mooresville, NC (US)

(73) Assignee: COLORZEN LLC, New York, NY (US)

( * ) Notice: Subject to any disclaimer, the term of this patent is extended or adjusted under 35 U.S.C. 154(b) by 119 days.

(21) Appl. No.: 15/111,950

(22) PCT Filed: Jan. 16, 2015

(86) PCT No.: PCT/US2015/011766

§ 371 (c)(1),
(2) Date: Jul. 15, 2016

(87) PCT Pub. No.: WO2016/114792

PCT Pub. Date: Jul. 21, 2016

(65) Prior Publication Data

US 2016/0362833 A1 Dec. 15, 2016

Related U.S. Application Data

(60) Provisional application No. 61/928,611, filed on Jan. 17, 2014.

(51) Int. Cl.

| | |
|---|---|
| ***D06P 5/22*** | (2006.01) |
| ***D06B 21/00*** | (2006.01) |
| ***D06B 15/00*** | (2006.01) |
| ***D06B 17/00*** | (2006.01) |
| ***D06B 5/22*** | (2006.01) |

(52) U.S. Cl.

CPC ..... *D06P 5/22* (2013.01); *D06B 5/22* (2013.01); *D06B 15/005* (2013.01); *D06B 17/00* (2013.01); *D06B 21/00* (2013.01)

(58) Field of Classification Search

CPC .. D06P 5/22; D06B 21/00; D06B 5/22; D06B 15/005; D06B 17/00

See application file for complete search history.

(56) References Cited

U.S. PATENT DOCUMENTS

| | | | | |
|---|---|---|---|---|
| 3,844,142 | A * | 10/1974 | Miller | D06F 95/00 34/236 |
| 4,753,089 | A | 6/1988 | Engel | |
| 5,989,296 | A | 11/1999 | Patton | |
| 2003/0056296 | A1* | 3/2003 | Hirsch | C09B 67/0096 8/102 |
| 2003/0110815 | A1* | 6/2003 | Poy | D06F 31/005 68/27 |
| 2011/0173761 | A1 | 7/2011 | Bringewatt et al. | |
| 2012/0298427 | A1 | 11/2012 | Bringewatt | |

FOREIGN PATENT DOCUMENTS

| | | | |
|---|---|---|---|
| DE | 2602845 | A1 | 7/1976 |
| DE | 102004024626 | A1 | 2/2006 |
| WO | 2014116230 | A1 | 7/2014 |

OTHER PUBLICATIONS

Intemational Search Report and Written Opinion dated May 4, 2015.

EPO Office action for application No. 15877371.3, Nov. 3, 2017, 8 pages.

* cited by examiner

*Primary Examiner* — Amina S Khan

(57) ABSTRACT

A method and apparatus for treating textiles and textile materials prior to dyeing said textiles or textile materials includes the steps of loading a textile substrate into a vessel and saturating the textile substrate therein with pre-treatment chemicals are described. The impregnated textile substrate and excess process solution are transferred into a hydraulic press having a flexible bladder. The press squeezes the textile substrate uniformly to remove the excess solution which is captured and recycled for reuse. The squeezed, impregnated textile substrate is stored in airtight containers to allow dyesite formation. The textile substrate is then neutralized, washed, and dried and as thus pre-treated can be dyed in an ecologically sustainable, energy-efficient, and economical process. The method and apparatus ensure uniform moisture pick-up and distribution of the chemical(s) throughout the textile substrate.

9 Claims, 5 Drawing Sheets

METHOD AND APPARATUS FOR PRE-TREATMENT OF NON CONTINUOUS TEXTILES

CROSS-REFERENCE TO RELATED APPLICATION

This application is based on and claims priority to International Application No. PCT/US2015/011766 filed Jan. 16, 2015 which is based on and claims priority to U.S. provisional patent application No. 61/928,611 filed Jan. 17, 2014. The entire contents of each and every foregoing application are incorporated herein by reference.

TECHNICAL FIELD AND BACKGROUND OF THE INVENTION

The present invention relates to the application of pre-treatments, chemicals, processing aids, and finishing agents to fibers, garments, and other non-continuous textiles and textile materials (alternatively referred to herein as "textile substrates"), and related apparatus to accomplish same in advance of dyeing the textile substrate. The present invention enables the dyeing of textile substrates using less dye, time, water, and energy than heretofore.

It is an object of the present invention to provide a method of applying pretreatments, chemicals, processing aids, and finishing agents to fibers, garments and other non-continuous textiles. It is a further object of the invention to provide an apparatus to accomplish the method.

SUMMARY OF THE INVENTION

The invention involves the application of a solution such as one containing an epoxy ammonium compound and an alkaline catalyst to fibers, garments, or other non-continuous textiles made of cotton or other cellulosic materials. See, for example, international patent application PCT/US2013/023180 published Jul. 31, 2014 as WO 2014/116230 A1, whose disclosure is incorporated herein in its entirety. After complete processing, permanent cationic dye sites are thereby attached to the molecules of cellulosic material. The formation of these dye sites allows the textile substrate to be dyed more efficiently and completely without having to use corrosive exhaust salts and high temperatures. Scouring and rinsing and the attendant use of large amounts of chemicals and water are drastically reduced. The total process saves substantial amounts of water, energy, time, and dyestuff compared to conventional dye processing. The result is an ecologically advantageous and efficient method that achieves excellent results.

The method or process for forming dye sites on the molecules of the cellulosic material uses a modification of equipment similar to that used in the laundry industry. In one embodiment of the invention, parts of a tunnel washer are used. A tunnel washer is a continuous washing device that conveniently includes a loading module on an input end, several modular washing and rinsing compartments, and a water extractor, such as a hydraulic press, to extract excess liquid at the exit end. The water-extracted textile materials are then transferred to a drying unit to finish the process.

The tunnel washer is not in itself an efficient or economical device for forming the dye sites. However, by uniquely combining the loading and saturator module with the hydraulic press and capturing and reusing the excess solution, an economical, ecologically efficient, and sustainable way of applying the liquid to non-continuous textiles is achieved. Intermediate washing and rinsing modules can accordingly be eliminated, resulting in a new apparatus that carries out a pre-finishing procedure quickly and efficiently. The impregnated textile substrate is stored or "batched" for a finite period (e.g., 8 to 24 hours at room temperature) until the reaction between the cellulosic material and the pre-treatment solution is completed, forming the dye sites on the molecules of the cellulosic textile substrate. Batching is the most energy efficient method of carrying out this reaction. The dye site formation process can also be accelerated by heating, steaming, or drying the impregnated textile under carefully controlled and monitored conditions.

In accordance with one embodiment of the invention, a method of pre-treating textiles in advance of dyeing them includes the steps of loading the textile into a vessel and saturating the textile with pre-treatment chemicals. The saturated textile and excess solution are transferred into a hydraulic press similar to the type used for dewatering with a tunnel wash unit in laundries. Excess chemical solution is required to ensure total impregnation of the textile substrate being processed. The press is engaged and uniformly squeezes the textile substrate to distribute the chemical equally throughout the textile substrate and to produce a predetermined moisture content of between about 65% and 140% by weight. The excess chemicals are extracted from the textile substrate and repeatedly recirculated back into the vessel for reaction with one or more subsequent load(s) of textile substrate. The textile substrate containing the remaining absorbed and squeezed chemical solution is then, in the same way as is described above, batched to form the dye site.

BRIEF DESCRIPTION OF THE DRAWINGS

The present invention is best understood when the following detailed description of the invention is read with reference to the accompanying drawings, in which.

DETAILED DESCRIPTION

Referring specifically to the drawings, a method and apparatus according to a preferred embodiment of the invention are illustrated. The process begins with a loading and saturating step wherein the textile substrate, which can be fibers, yarns, or fabricated goods such as hosiery or other apparel, is loaded into a vessel wherein the goods are tumbled, oscillated or otherwise mechanically agitated in the saturator unit in the presence of pre-treatment chemicals to ensure complete and thorough wetting of the textile substrate to the point of complete saturation. The cellulosic textile material is thus saturated with a solution containing a cationic molecule, an alkaline catalyst, and wetting surfactant. Saturation results in the chemical solution impregnating 100% of the textile substrate so that the maximum number of dye sites being available for processing are formed. The type of vessel is critical so that all of the textile substrate is exposed to and absorbs the chemical solution. The textile substrate impregnated with the solution and pressed to a predetermined moisture content is batched to allow the reaction to form permanent cationic sites.

Figure 1:
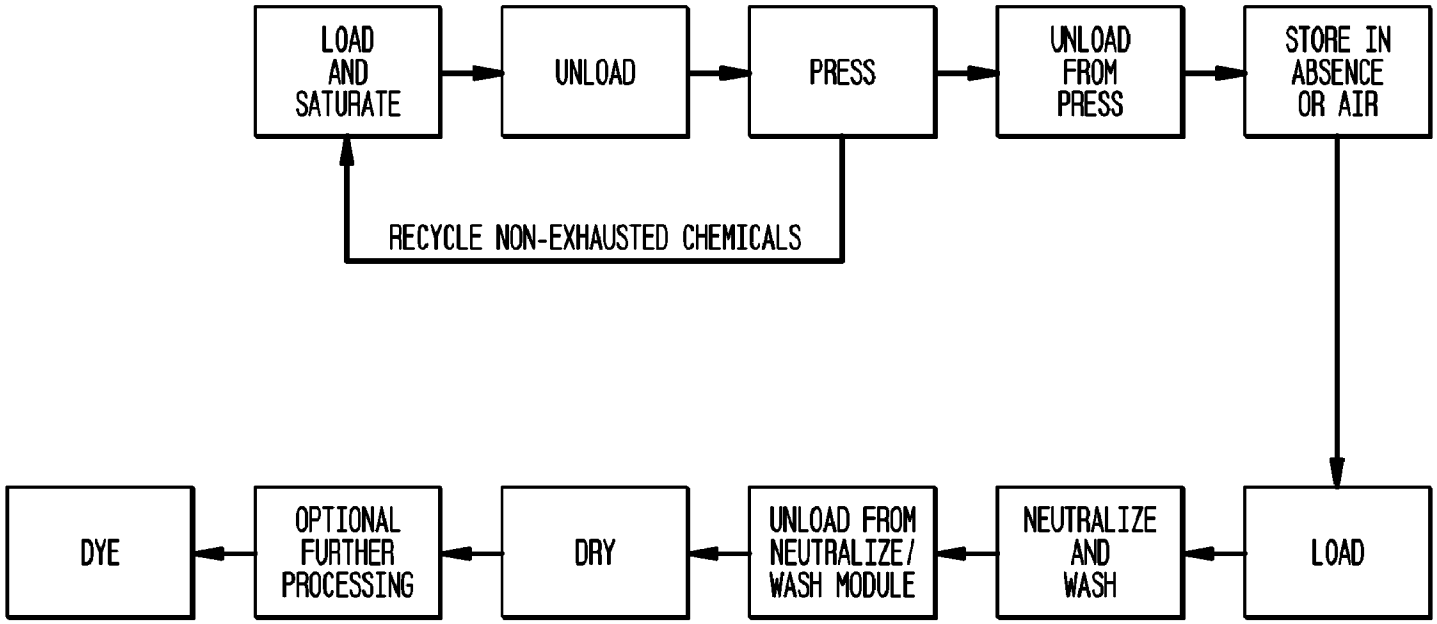
FIG. 1 is a flow diagram of a method of pre-treating textiles according to one embodiment of the invention.
Figure 2:
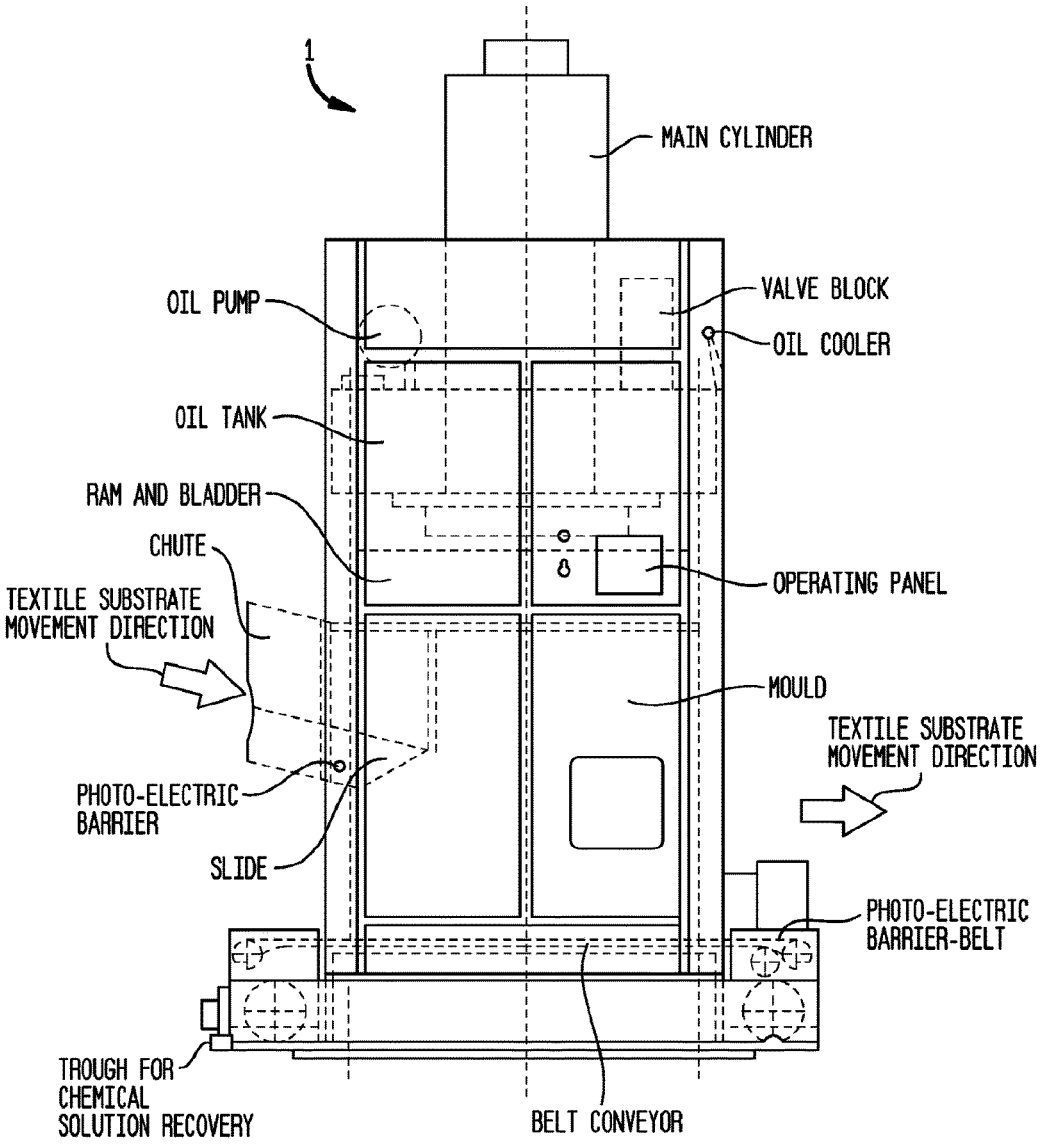
FIG. 2 is a cross-sectional view of a press of a type normally used for dewatering with tunnel wash units.
Figure 3:
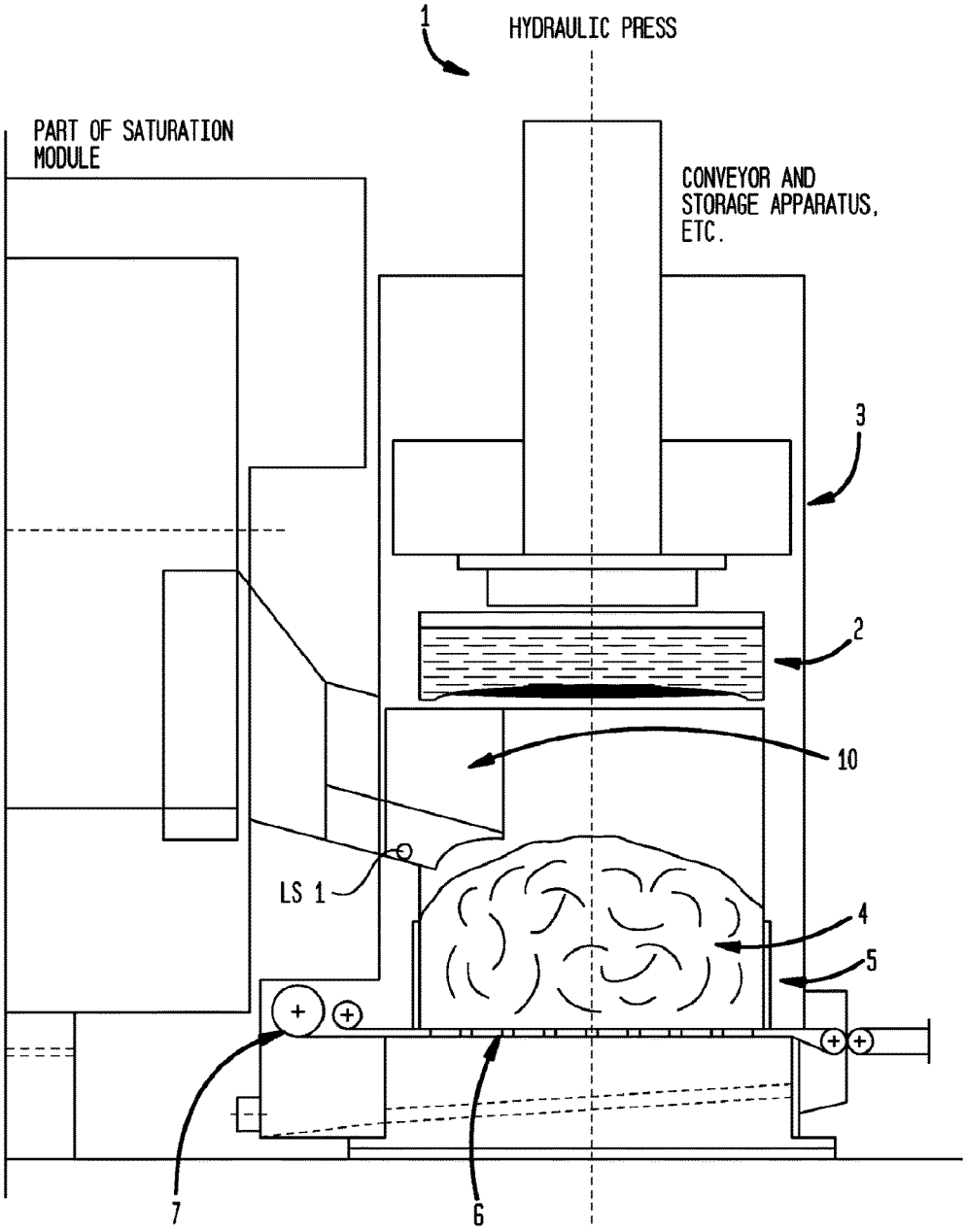
FIGS. 3, 4, and 5 are sequential views showing the substrate loading, pressing, and unloading, respectively in the operation of the press of FIG. 2.
Figure 4:
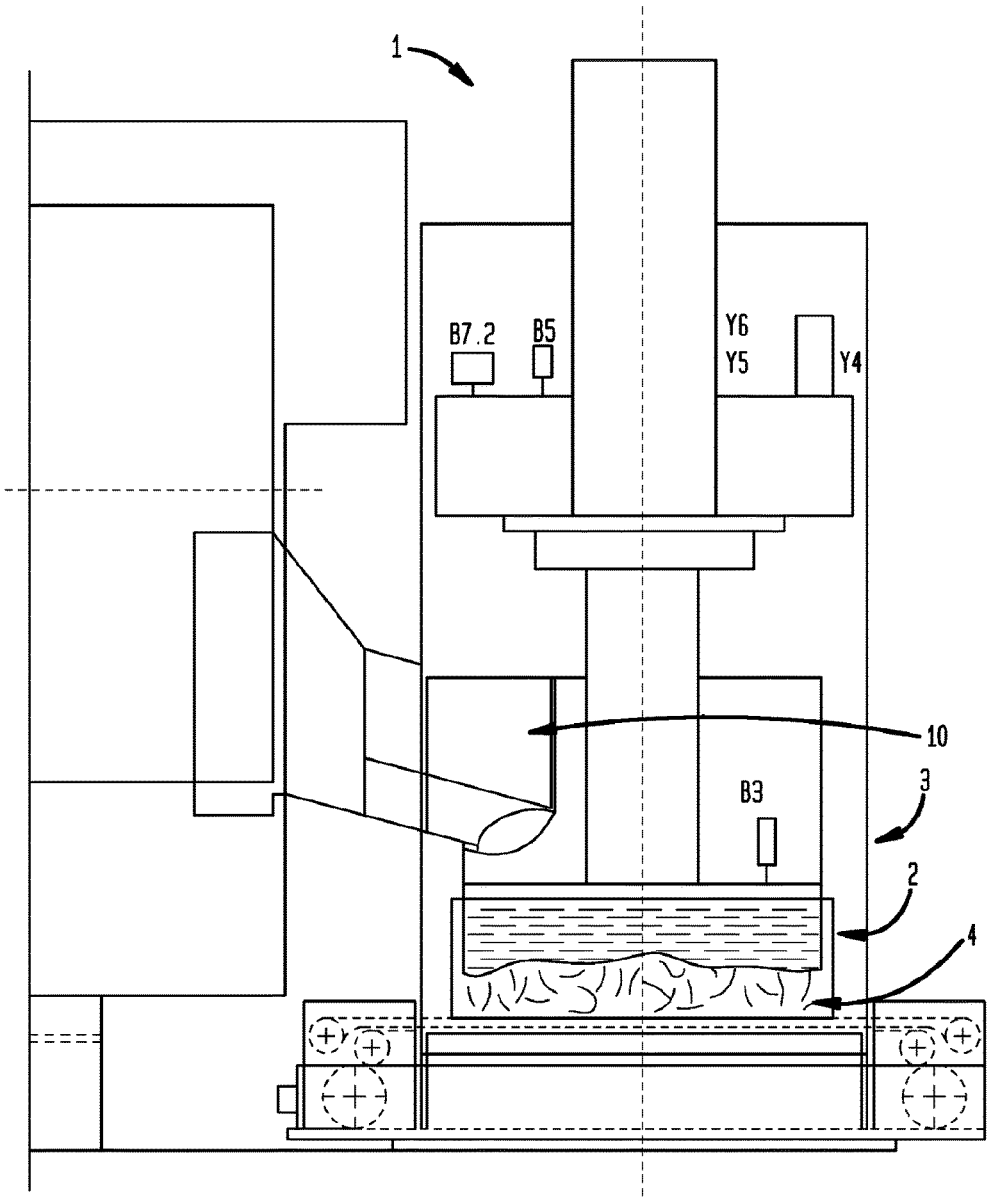
Figure 5:
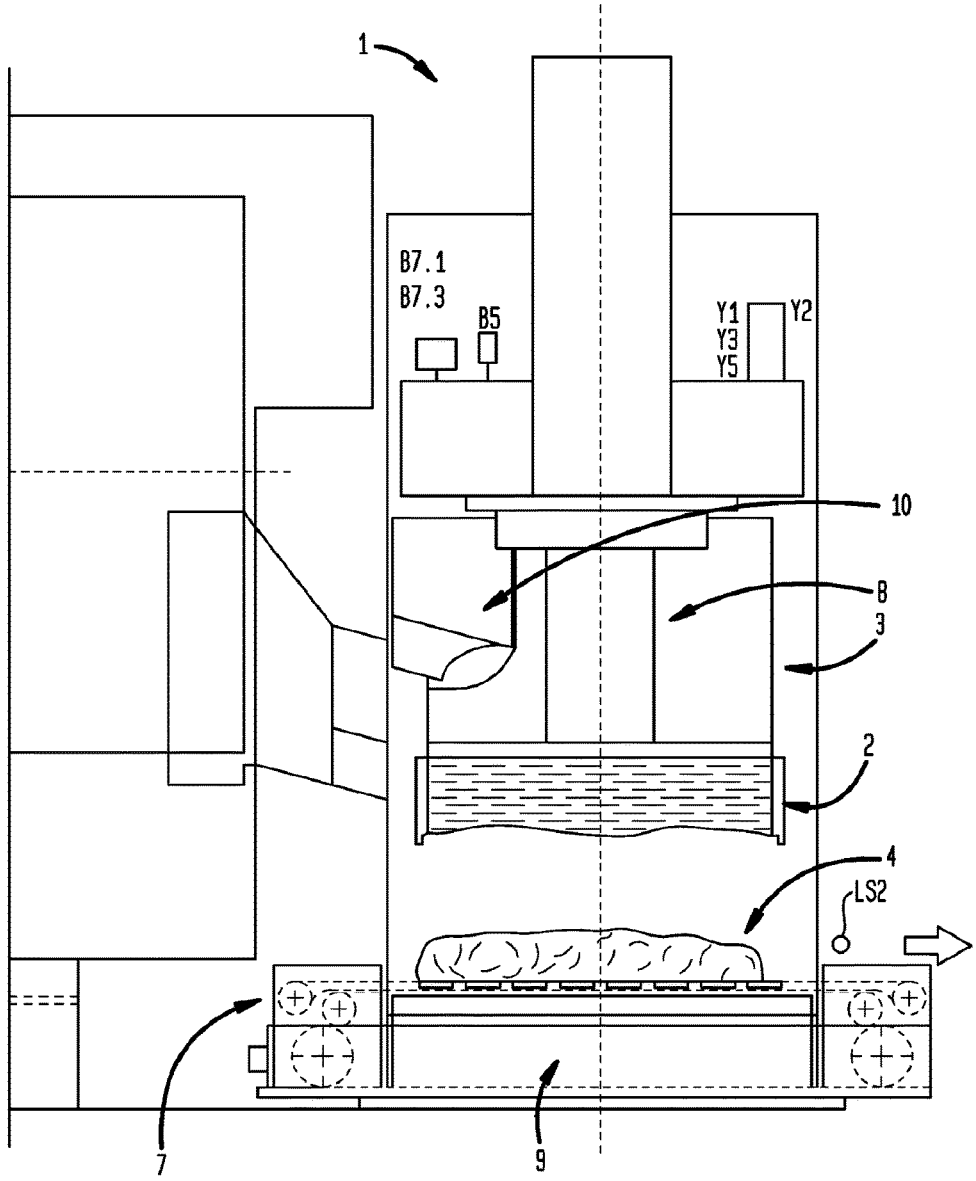

As also shown in FIG. 1, the impregnated textile material is unloaded from the vessel and placed into a press, such as the hydraulic press 1 shown in FIG. 2 via a slide 10 as shown in FIG. 3. A hydraulic press such as the type that is deployed in commercial laundries typifies an apparatus suitable for adaptation for use in the present invention. As shown in FIGS. 3 through 5, the hydraulic press has a flexible water-filled diaphragm 2 disposed between the ram 3 and the saturated textile 4. As demonstrated sequentially in FIGS. 3, 4 and 5, as the ram 3 engages the saturated textile substrate 4, the flexible diaphragm 2 conforms to the shape and configuration of the textile substrate bundle inside the press compartment. This equalizes the pressure across the entire textile substrate 4. The result is an even distribution of solution throughout the substrate 4 as it is being squeezed of excess chemical solution.

Referring to FIG. 3, loading of the press 1 occurs when the ram 3 is initially in the UPPER position, and the mould 5 sits on the bench 6 in the LOWER position. The belt 7 is switched off. The saturator module partially shown in FIGS. 3, 4, and 5 of the apparatus receives the release signal: the press is ready to be loaded. The mould 5 is loaded with an amount of textile substrate 4 from the saturator module of the apparatus. The photo-electric barrier LS1 for the slide monitors loading. After passage of the textile substrate, once the slide is clear, pressing begins.

Referring to FIG. 4, the hydraulic functions are started by activating the pressure valve Y5. The ram lowers itself using the valve Y4. If the diaphragm is in contact with the textile substrate, the pressure switch B5 switches to "slowly down". As a result of the precompression (i.e., the even application of a small amount of pressure at the beginning) of the washing, the operating pressure rises until the admission pressure B7.2 is reached. At the same time, a switchover is made to the "pressing" function by means of the Y6 valve. The pressure increases until the diaphragm pressure preselected in the relevant program is reached. The effect on the textile substrate continues until the end of the pressing time, which has also been preselected in the program. Pressure switch B5 monitors the diaphragm pressure during the pressing procedure.

In addition to the hydraulic and pressing functions, referred to in the preceding paragraph, three auxiliary functions of the press, namely, item height, phased pressing, and ventilating can be programmed.

Referring to FIG. 5, first, there is a reduction in pressure by means of an hydraulic pump (not shown). This is monitored by pressure switch B7.1. The ram 3 is retracted upwards to an intermediate position above the belt 7 which enables the loosening of the pressed-out textile substrate 4. (Note that the slide 10 is shown displaced from its actual position in order to show more clearly the movement of the ram 8.) If the belt for holding the textile substrate is ready, the mould travels upwards by means of the valve Y1. The plunger 8 continues travelling upwards (Y3) until it reaches the position "Stop at top". The conveyor belt 7 is activated. Photo-electric barrier LS2 monitors the passage of the textile substrate 4. After the textile substrate has left the belt and the latter has come to a stop, the mould travels downwards by means of the Y2 valve and returns to its lower position. Pressure switch B7.3 switches the press off in the case of excess pressure in the hydraulic system.

It is necessary to note that the belt is porous to liquids, and otherwise allows excess liquid to flow into the trough 9. In the specific case of the dye site formation, the excess epoxy/alkaline solution is captured and reused preferably within a short period. By reintroducing this excess volume of liquid extracted at the press and returning it by a conduit to the vessel where the textile substrate is being loaded and saturated, it is not necessary to discharge this liquid into a sewer system, river, or other discharge receptacle. Effectively, the unabsorbed chemical solution is thus captured and recycled into the saturator unit by this method. It is necessary to add additional chemicals to the saturation unit at a rate sufficient to replace the chemical solution retained by the previous textile substrate lot and to maintain the concentration at a level that insures proper processing. The chemical liquid feed system is effectively a "closed" system wherein the recycled liquid is recirculated to the vessel repeatedly via the conduit which can be attached, if desired, to an intermediate tank for storage of the recycled chemical solution prior to its reintroduction into the saturator unit. By recapturing and reusing the solution as shown in FIG. 1, over 80% of the cost of the process can be eliminated in addition to substantially reducing the ecological burden on the environment.

Referring again to in FIG. 1, after pressing the textile substrate to extract the liquid to be recycled, the substrate is stored, or "batched", for a period of time in the absence of air to allow the pre-treatment chemicals to fully develop the desired dye sites. The treated textile material typically is stored at room temperature for a period ranging from 8 to 24 hours. Batching must take place in the absence of air because air can neutralize or prevent the reaction from forming the dye sites. Adjustments to the solution formula can extend the time before neutralization occurs but typically storage under vacuum or in an inert gas atmosphere is desired. For this reason the textiles can be tightly packed into bags, drums or containers during the storage and/or heating interval to minimize the destructive exposure to air. The batch time can be shortened or eliminated by applying heat under strictly controlled conditions. The "curing" conditions must also be carefully monitored and adjusted in the absence of air.

Once the chemical saturation and batching process is complete, the textile substrate can be neutralized, washed, and dried as shown in FIG. 1 in an economical and highly productive manner by using a second tunnel washer unit modified to effectively handle the relevant type of textile substrate. Typically, the process is completed by tumble drying. Suitable dryers, including radio frequency, continuous gas, or microwave-type dryers, can be integrated into the process if desired.

The pre-treated textile substrate is now ready for further processing, e.g., spinning into yarn, and/or dyeing in an ecologically advantageous and highly efficient manner.

The method and apparatus for applying pre-treatments, processing aids, and finishing agents to fibers, garments and other non-continuous textiles, and a related apparatus to accomplish the method according to the invention have been described with reference to specific embodiments and examples. Various details of the invention can be changed without departing from the scope of the invention. Furthermore, the foregoing description of the preferred embodiments of the invention and best mode for practicing the invention are provided for the purpose of illustration only and not for the purpose of limiting the scope of the invention, which is defined by the following claims.

The invention claimed is:

1. A method of pre-treating textiles in advance of a dyeing process, comprising the steps of:

(a) loading a textile substrate into a vessel;

(b) saturating the textile substrate with pre-treatment chemicals in the vessel, wherein the pre-treatment chemicals include an alkaline catalyst;

(c) unloading the pre-treated textile substrate from the vessel;

(d) loading the textile substrate unloaded in step c into a mould included in a hydraulic press;

(e) extracting the pre-treatment chemicals from the textile substrate in the mould;

(f) unloading the textile substrate from the mould via a porous conveyer belt integrated into the hydraulic press; and (g) recirculating the extracted pre-treatment chemicals from the hydraulic press back to the vessel.

2. A method according to claim 1 wherein the textile substrate is a non-continuous textile made of cellulosic material; and the textile substrate unloaded in step (f) is stored in the absence of air for a period to allow the pre-treatment chemicals to fully develop the desired dye sites on the cellulosic molecules of the textile material.

3. A method according to claim 2 wherein the textile substrate stored for said period is loaded into a neutralizer/wash module and neutralized, washed, and then dried.

4. A method according to claim 1 wherein the textile substrate is made of fibers or yarn.

5. A method according to claim 1 wherein the pre-treatment chemicals is extracted from the textile substrate until the textile substrate reaches a predetermined moisture content level.

6. A method according to claim 5 wherein the predetermined moisture content level is between 65% and 140% by weight.

7. A method according to claim 1, additionally comprising the step of:

(h) curing the textile substrate in the absence of air by applying heat.

8. A method according to claim 7 wherein the curing occurs in a vacuum or in an atmosphere of inert gas.

9. A method according to claim 1 wherein the force from a ram included in the hydraulic press is evenly applied across the entire textile substrate, the ram is configured to distribute the pre-treatment chemicals evenly throughout the textile substrate.

* * * * *